US005910359A

United States Patent [19]

Kobayashi et al.

[11] Patent Number: 5,910,359

[45] Date of Patent: Jun. 8, 1999

[54] RECORDING SHEET AND IMAGE FORMING METHOD

[75] Inventors: Takashi Kobayashi; Tatsuya Nomura, both of Shizuoka, Japan

[73] Assignee: Fuji Photo Film Co., Ltd., Kanagawa, Japan

[21] Appl. No.: 08/725,179

[22] Filed: Oct. 3, 1996

[30] Foreign Application Priority Data

Oct. 4, 1995 [JP] Japan ..... 7-282496
Jun. 14, 1996 [JP] Japan ..... 8-175910

[51] Int. Cl.[6] ..... B41M 5/00; B41J 2/01

[52] U.S. Cl. ..... 428/327; 347/105; 428/195; 428/207; 428/500; 428/520

[58] Field of Search ..... 347/105; 428/195, 428/207, 323, 327, 500, 520

[56] References Cited

U.S. PATENT DOCUMENTS 5,198,408 3/1993 Martin ..... 503/227
5,662,997 9/1997 Onishi et al. ..... 428/331

*Primary Examiner*—Bruce H. Hess
*Attorney, Agent, or Firm*—Sixbey, Friedman, Leedom & Ferguson, P.C.; Gerald J. Ferguson, Jr.

[57] ABSTRACT

A recording sheet for ink-jet recording has a transparent support and a transparent colorant-receptive layer, in which the colorant-receptive layer is composed of crosslinked polymer particles having a mean particle diameter of not more than 200 nm and a water-soluble resin, and has a transmittance of not lower than 80%. Another recording sheet for ink-jet recording has an opaque support having a high gloss and the transparent colorant-receptive layer having a gloss of not lower than 70%.

12 Claims, 1 Drawing Sheet

RECORDING SHEET AND IMAGE FORMING METHOD

FIELD OF THE INVENTION

The present invention relates to a recording sheet for forming an image of high transparency or an image having high gloss utilizing ink-jet recording, and an image forming method using the recording sheet by ink-jet recording.

BACKGROUND OF THE INVENTION

As information industry rapidly has recently advanced, a variety of information processing systems, and recording methods or apparatuses suitable for those information processing systems have been developed and employed. In such recording methods, there is known ink recording using a jet for emitting ink or a plotter and thermal transfer recording using a melt type colorant or a sublimation type colorant. Apparatuses employed for the ink jet recording method are lightweight, compact-sized and noiseless and further are excellent in workability and maintainance. Moreover, the apparatuses used in those recording methods can be easily modified to enable color recording, and hence those recording methods have been widely used in recent years.

Recording methods for the ink-jet recording can be roughly classified into three methods: a method of using an aqueous dye solution of a water-soluble dye (aqueous ink), a method of using a dye solution obtained by dissolving an oil-soluble dye in an organic solvent (oily ink), and a method of using a molten solid wax containing a dye (wax ink). The method of using the aqueous ink is mainly adopted. In any of those methods, an image is formed by emitting the ink in the form of fine droplets onto a recording sheet.

The ink-jet recording method is utilized for forming an image not only on a paper sheet but also on a transparent sheet. The transparent sheet can be employed for preparing the various films such as OHP films, films for back light display, and intermediates. In more detail, the OHP films have been widely used for presentation in place of slides, the films for back light display have been widely used in place of printed posters or display boards, and the intermediates are prints which are used as a master for further reproduction. Such transparent sheet (recording sheet) usually comprises a transparent film and a colorant-receptive (absorbing) layer provided thereon. Also in the transparent sheet, an image is formed thereon as described above, so as to prepare an image of high transparency, that is, an image fixed on a clear base especially adaptable for viewing by means of transmitted light.

Further, a hard copy in which an image is formed on a sheet by the ink-jet recording method is occasionally required to have a high gloss. In more detail, the hard copy is also desired to have a high gloss appearing close to that of silver-salt photography.

An image formed on the transparent recording sheet by the ink-jet recording method is usually required to show excellent hue, saturation, and lightness. Moreover, the ink-jet recording needs a transparent recording sheet to rapidly absorb a liquid ink and to fix a liquid ink on a colorant-receptive layer (whereby ink forming the ink image is not allowed to transfer to other sheets), and further not to allow bleeding or blooming of ink, from the view-point of obtaining a clear image. The amount of ink (of ink image) unfixed on the colorant-receptive layer can be evaluated by a density of ink transferred on a white paper sheet when the paper sheet is pressed on the sheet having an ink image thereon.

The transparent recording sheet usually comprises a transparent film and a colorant-receptive layer provided thereon.

The conventional colorant-receptive layer consisting mainly of resin shows a high transparency, but an amount of unfixed ink on the colorant-receptive layer is not satisfactorily reduced because the resin is apt to swell or dissolve in ink to show adhesiveness.

For example, use of a soluble or swelling substance in a colorant-receptive layer is proposed in Japanese Patent Provisional Publication No. 56(1981)-80489. Further, a great number of polymers (e.g., polyvinyl alcohol (PVA), polyvinyl pyrrolidone (PVP), polyethylene oxide (PEO) and carboxymethyl cellulose (CMC)) are also mentioned. The proposed colorant-receptive layer utilizes penetration effect of the aqueous ink owing to the hydrophilic group or the dissociation group of the polymer, and hence, even if the film is formed to have increased thickness, a satisfactory ink absorption speed and a satisfactory reduction of an amount of the unfixed ink cannot be obtained.

Japanese Patent Provisional Publication No. 3(1991)-104638 discloses use of crosslinked polyvinyl pyrrolidone in a colorant-receptive layer. Such a colorant-receptive layer slightly reduces an amount of the unfixed ink on the colorant-receptive layer, but it still is not satisfactory.

In order to solve those problems, various transparent sheets for forming an image of a transparency (i.e., transparent sheet having a transparent image) using inorganic particles have been proposed, such as the following:

Japanese Patent Provisional Publications No. 57(1982)-14091 and No. 61(1986)-19389 disclose a recording sheet comprising a support and a transparent layer composed of colloidal silica and water-soluble resin. The transparent layer does not has a high void volume, and therefore, the recording sheet does not give a satisfactory ink absorption speed and satisfactory reduction of an amount of the unfixed ink. Further, a recording sheet having a colorant-receptive layer having fine pores which is formed of pseudo-boehmite fine particles is described in Japanese Patent Provisional Publications No. 2(1990)-276670 and No. 3(1991)-281383. According to the studies by the inventor, however, it has been found that sufficient transparency cannot be obtained by this recording sheet because of its high refractive index of about 1.65, though the ink absorption property is satisfactorily improved and an amount of unfixed ink of the obtained ink image is satisfactorily reduced.

Japanese Patent Publication No. 61(1986)-53958 discloses a recording sheet comprising a transparent support and a transparent layer composed of synthetic silica, fine inorganic particles of refractive index of 1.44–1.55 and a water-soluble resin. The synthetic silica usually has a mean primary particle diameter of more than 10 nm, and further contains secondary particles having size of several hundreds nm. Therefore, the secondary particles are apt to scatter light applied thereto, whereby the recording sheet containing the particles can not show a satisfactory light transmittance. Further, the transparent layer has relatively large pores due to the large secondary particles and hence does not satisfactorily prevent occurrence of bleeding or blooming of ink.

Further, the following publications disclose a recording sheet having a layer of latex or polymer particle provided on a sheet.

Japanese Patent Publication No. 62(1987)-11678 discloses a sheet for ink-jet recording using a specific basic latex (polymer), which shows a satisfactory ink absorption speed and satisfactory reduction of amount of non-fixed ink of ink image. The specific basic latex is prepared by copolymerizing a monomer having a tertiary amino group or quaternary ammonium salt group, a monomer having two or more ethylenically unsaturated groups and a monomer other than these monomers. The colorant-receptive layer comprising the specific basic latex shows a satisfactory ink absorption speed and satisfactory reduction of an amount of unfixed ink on the colorant-receptive layer, but does not show a high transmittance because the particle size of the latex is large (generally approx. 0.5 μm). In Example of the publication, a sheet wherein a colorant-receptive layer of the specific basic latex is formed on a paper sheet as well as a sheet wherein a colorant-receptive layer of the specific basic latex and an amount of calcium carbonate is formed on a transparent sheet, are described. Hence, the publication does not disclose a transparent recording sheet.

Japanese Patent Provisional Publication No. 5(1993)-254251 discloses a heat-sensitive recording sheet containing as a binder a micro gel, which is prepared by copolymerizing a polymerizable monomer such as alkyl (meth)acrylate or styrene and an emulsifier having at least one carbon-carbon double bond. In Example of the publication, a coating liquid containing a micro gel is coated on a paper sheet to prepare a heat-sensitive recording sheet. Hence, the publication does not disclose a transparent recording sheet, and also that for ink-jet recording. Further, in the heat-sensitive recording method, an image is formed by heating locally a recording sheet, on the other hand, in the ink-jet recording an image is formed by jetting ink onto the recording sheet. Therefore, these recording methods apparently differ from each other in the field of art.

SUMMARY OF THE INVENTION

It is an object of the present invention to provide a recording sheet having a colorant-receptive layer which is preferably employed for preparing a transparency (a sheet having a transparent color image on a transparent support) by ink-jet recording.

It is another object of the invention to provide a recording sheet which has high transmittance and is capable of forming an image thereon with little unfixed ink of the image remainig on the colorant receptive layer or occurrence of bleeding or blooming of ink under high humidity (the amount of unfixed ink of the image on the colorant receptive layer can be determined by measuring a density of ink on a white paper sheet transferred when the paper sheet is pressed on the sheet having an ink image thereon).

It is a further object of the invention to provide a recording sheet which has high gloss and is capable of forming an image thereon with little unfixed ink of the image remainig on the colorant receptive layer or occurrence of bleeding or blooming of ink under high humidity by ink-jet recording.

It is a still further object of the invention to provide an image forming method for preparing, by ink-jet recording, a transparency (transmission image) which is almost free from production of unfixed ink of the image or occurrence of bleeding or blooming of ink under high humidity.

It is a still further object of the invention to provide an image forming method for preparing, by ink-jet recording, an image which has high gloss and is almost free from production of unfixed ink of the image or occurrence of bleeding or blooming of ink under high humidity.

There is provided by the invention a recording sheet comprising a transparent support and a transparent colorant-receptive layer provided thereon, in which the colorant-receptive layer comprises crosslinked polymer particles having a mean particle diameter of not more than 200 nm and a water-soluble resin, the recording sheet having a transmittance of not lower than 80%.

The transmittance is defined as a value of transmittance of parallel rays (having wavelengths in the range of 380 to 800 nm) which can be measured by the use of haze meter (Trade name: HGM-2DP, available from Suga Testing Machine Co., Ltd.).

Preferred embodiments of the recording sheet of the invention are described below.

1) The recording sheet wherein the crosslinked polymer particles are anionic or cationic polymer particles.
2) The recording sheet wherein the mean particle diameter of the crosslinked polymer particles is in the range of 1 to 100 nm.
3) The recording sheet wherein the crosslinked polymer particles are a micro-gel obtained by emulsion polymerization of at least one monomer selected from the group consisting of alkyl acrylates, alkyl methacrylates, styrene, and styrene derivatives in the presence of an emulsifier having at least one (preferably two or more) carbon-carbon double bond in its molecule.
4) The recording sheet wherein the crosslinked polymer particles are cationic polymer particles (preferably, particles have a quaternary ammonium salt group).
5) The recording sheet wherein the water-soluble resin is crosslinked.
6) The recording sheet wherein the water-soluble resin comprises polyvinyl alcohol.
7) The recording sheet wherein the water-soluble resin comprises at least one polymer selected from the group consisting of polyvinylpyrrolidone and a copolymer of vinylpyrrolidone and a monomer copolymerizable with the vinylpyrrolidone.
8) The recording sheet wherein the water-soluble resin comprises polyvinyl alcohol and at least one polymer selected from the group consisting of polyvinylpyrrolidone and a copolymer of vinylpyrrolidone and monomer copolymerizable with the vinylpyrrolidone.
9) The recording sheet wherein the ratio of the crosslinked polymer particles and the water-soluble resin is in the range of 1:1 to 1:10 (polymer particles:water-soluble resin) by weight.
10) The recording sheet wherein the transparent colorant-receptive layer further contains a matting agent (lubricant) in an amount of 0.01 to 5 weight %.
11) The recording sheet wherein the transparent support has a subbing layer thereon.
12) The recording sheet as above 11) wherein the subbing layer comprises at least one polymer selected from the group consisting of styrene/butadiene copolymer, polyvinylidene chloride, polyvinylidene chloride fluoride, polyvinylidene fluoride, polyester, polyamide and acrylic resin.
13) The recording sheet as above 11) wherein the subbing layer comprises styrene/butadiene latex or polyvinylidene chloride latex.
14) The recording sheet as above 11) wherein the subbing layer is crosslinked.
15) The recording sheet as above 11) wherein the subbing layer is cured by a crosslinking agent.
16) The recording sheet wherein the transparent support comprises polyester.
17) The recording sheet wherein the transmittance is a value of not lower than 83% (especially not lower than 85%).

18) The recording sheet wherein the transmittance of a light at wavelength of 400 nm is a value of not lower than 80% (especially not lower than 83%).

The recording sheet is advantageously utilized in the following image forming method (image recording method): that is, an image forming method comprising imagewise jetting an aqueous ink on the transparent colorant-receptive layer of the above-mentioned recording sheet having transmittance of not lower than 80% to form an image of aqueous ink on the transparent colorant-receptive layer.

In the image forming method, the imagewise jetting of an aqueous ink is preferably conducted using an ink-jet printer, and the aqueous ink preferably contains water in an amount of not less than 50 weight %.

There is further provided by the invention a recording sheet comprising an opaque support having high gloss and a transparent colorant-receptive layer provided thereon, in which the colorant-receptive layer comprises crosslinked polymer particles having a mean particle diameter of not more than 200 nm and a water-soluble resin, the recording sheet having gloss of not lower than 70%.

The gloss is defined as a value of 75 degree specular gloss, which is measured according JIS P-8142 (Testing method for 75° specular gloss of paper and paperboard).

Preferred embodiments of the recording sheet of the invention are described below.

1) The recording sheet wherein the crosslinked polymer particles are anionic or cationic polymer particles.
2) The recording sheet wherein the mean particle diameter of the crosslinked polymer particles is in the range of 1 to 100 nm
3) The recording sheet wherein the crosslinked polymer particles are a micro-gel obtained by emulsion polymerization of at least one monomer selected from the group consisting of alkyl acrylates, alkyl methacrylates, styrene, and styrene derivatives in the presence of an emulsifier having at least one (preferably two or more) carbon-carbon double bond in its molecule.
4) The recording sheet wherein the crosslinked polymer particles are cationic polymer particles (preferably particles have a quaternary ammonium salt group).
5) The recording sheet wherein the water-soluble resin is crosslinked.
6) The recording sheet wherein the water-soluble resin comprises polyvinyl alcohol.
7) The recording sheet wherein the water-soluble resin comprises at least one polymer selected from the group consisting of polyvinylpyrrolidone and a copolymer of vinylpyrrolidone and a monomer copolymerizable with the vinylpyrrolidone.
8) The recording sheet wherein the water-soluble resin comprises polyvinyl alcohol and at least one polymer selected from the group consisting of polyvinylpyrrolidone and a copolymer of vinylpyrrolidone and a monomer copolymerizable with the vinylpyrrolidone.
9) The recording sheet wherein the ratio of the crosslinked polymer particles and the water-soluble resin is in the range of 1:1 to 1:10 (polymer particles:water-soluble resin) by weight.
10) The recording sheet wherein the transparent colorant-receptive layer further contains a matting agent (lubricant) in an amount of 0.01 to 5 weight % per the amount of the colorant-receptive layer.
11) The recording sheet wherein the opaque support has a subbing layer thereon.
12) The recording sheet as above 11) wherein the subbing layer comprises at least one polymer selected from the group consisting of styrene/butadiene copolymer, polyvinylidene chloride, polyvinylidene chloride fluoride, polyvinylidene fluoride, polyester, polyamide, and acrylic resin.
13) The recording sheet as above 11) wherein the subbing layer comprises styrene/butadiene latex or polyvinylidene chloride latex.
14) The recording sheet as above 11) wherein the subbing layer is crosslinked.
15) The recording sheet as above 11) wherein the subbing layer is cured by a crosslinking agent.
16) The recording sheet wherein the gloss is a value of not lower than 75% (especially not lower than 80%).

The recording sheet is advantageously utilized in the following image recording method.

An image recording method comprising imagewise jetting an aqueous ink onto the transparent colorant-receptive layer of the above-mentioned recording sheet having a gloss of not lower than 70% and forming an image of aqueous ink on the transparent colorant-receptive layer.

In the image forming method, the imagewise jetting of an aqueous ink is preferably conducted using a ink-jet printer, and the aqueous ink preferably contains water in an amount of not less than 50 weight %.

The transparent colorant-receptive layer of the recording sheet of the invention is a layer that the crosslinked polymer particles having a mean particle diameter of not more than 200 nm are uniformly dispersed in the water-soluble resin. It is estimated that an aqueous ink jetted from a nozzle of an ink-jet printer is absorbed in the crosslinked polymer particles and the water-soluble resin, and between the crosslinked polymer particles and the water-soluble resin. In the case that the ink is jetted onto a colorant-receptive layer composed of water-soluble resin only, after the colorant-receptive layer absorbs the ink, the layer swells by the ink to leave a large amount of unfixed ink (of ink image) on the colorant-receptive layer. In the transparent colorant-receptive layer of the invention, an amount of the ink that the water-soluble resin of the layer adsorbs is a little, and therefore the layer scarcely swells by the ink, whereby the layer scarcely leaves unfixed ink on the colorant-receptive layer. Particularly, in the case that the crosslinked polymer particles are anionic or cationic (preferably cationic) polymer particles, the amount of unfixed ink is greatly reduced because the particles have a strong affinity for the ink. Moreover, since the transparent colorant-receptive layer of the invention needs not to contain inorganic particles which are usually employed to reduce an amount of unfixed ink and therefore the transparent colorant-receptive layer shows high transmittance, the recording sheet having the layer is suitably employed for forming OHP sheet. Further, also in the case that the transparent colorant-receptive layer is provided on an opaque support having high gloss, the resultant recording sheet shows high gloss without reducing the gloss of the support. An image formed on the recording sheet by ink-jet recording also shows a high quality.

Furthermore, the crosslinked polymer particles in the transparent colorant-receptive layer have a small mean particle size (i.e., not more than 200 nm), and therefore a light at lower wavelength of visual rays (e.g., a light of 400 nm) is scarcely scattered on the layer, whereby the image formed on the layer shows good transparency and has a high quality.

DETAILED DESCRIPTION OF THE INVENTION

Figure 1:
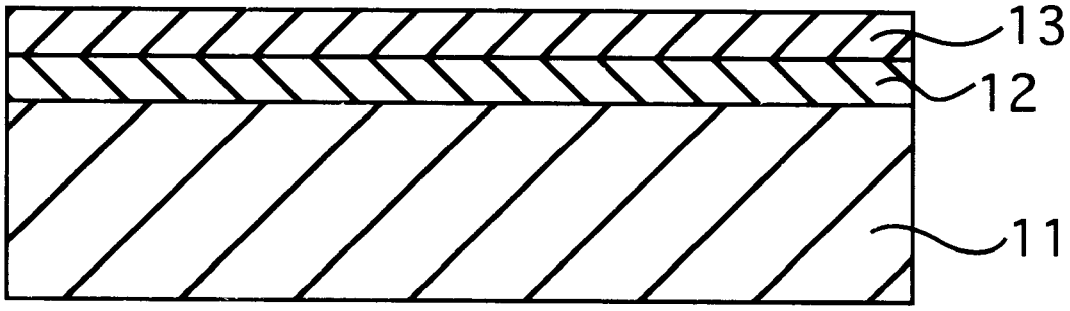
FIG. 1 is a section view illustrating a representative structure of the recording sheet of the invention.

The recording sheet of the invention has a basic structure comprising a support and a transparent colorant-receptive layer provided on the support. The recording sheet is particularly useful for ink-jet recording.

FIG. 1 is a section view of a representative structure of the recording sheet. The recording sheet is composed of a support 11, a subbing layer 12 thereon and a transparent colorant-receptive layer 13 provided on the subbing layer. The support 11 is a transparent support or an opaque support having high gloss. The subbing layer is preferably provided to improve a bonding force between the support and the transparent colorant-receptive layer, but the subbing layer may not be formed. The transparent colorantreceptive layer and/or the subbing layer can be formed on both sides of the support.

The recording sheet of the invention is, for example, prepared in the following manner.

The support of the recording sheet is selected from a transparent support and an opaque support having high gloss.

For a film used as the transparent support, any materials can be used so far as they have such properties as resistant to radiant heat under when the recording sheet is used for OHP or back light displaying. Examples of the materials include polyesters such as polyethylene terephthalate, cellulose esters such as nitrocellulose, cellulose acetate and cellulose acetate butyrate, polysulfone, polyphenylene oxide, polyimide, polycarbonate and polyamide. Preferred is polyester, and especially polyethylene terephthalate. Although there is no specific limitation on the thickness of the film, the thickness is preferably in the range of 50 to 200 $\mu$m from viewpoint of easy handling.

The opaque support having high gloss is preferred to be a support having a gloss of not less than 40% on the surface on which the transparent colorant-receptive layer is formed. The gloss is defined as a value of 75 degree specular gloss, which is measured according JIS P-8142 (Testing method for 75° specular gloss of paper and paperboard).

Examples of the opaque supports include high-gloss papers such as an art paper, a coated paper, a cast-coated paper and a baryte paper employable for support for photography; opaque plastic films having high gloss obtained by subjecting opaque plastic films to calendar treatment, the opaque plastic films being made of a white pigment and plastics such as polyesters (e.g., polyethylene terephthalate (PET)), cellulose esters (e.g., nitrocellulose, cellulose acetate and cellulose acetate butyrate), polysulfone, polyphenylene oxide, polyimide, polycarbonate and polyamide; sheets (films or paper sheets) wherein a polyolefin layer or a polyolefin layer containing a white pigment is provided on the above paper sheets, the above opaque plastic films or the above transparent plastic films; paper sheets having a metal deposited layer thereon and porous polyester films containing a white pigment (e.g., film prepared by stretching a PET film containing a polyolefin particles and a calcium carbonate to form pores in the film). Preferred are paper sheets having a white pigment-containing polyolefin layer thereon (especially those employed for photographic paper sheet), polyester (especially PET) films having a white pigment-containing polyolefin layer thereon, polyester films containing a white pigment, and porous polyester films containing a white pigment. Although there is no specific limitation on the thickness of the support, the thickness is preferably in the range of 50 to 200 $\mu$m from the viewpoint of easy handling.

On the support, a subbing layer is preferably provided. The subbing layer comprises a polymer. Examples of the polymers include styrene/butadiene copolymer, polyvinylidene chloride, polyvinyl chloride, polyvinyl acetate, polyvinyl formal, polyvinyl butyral, polyvinylidene chloride fluoride, polyvinylidene fluoride, polyester, polyamide and acrylic resin. Preferred are styrene/butadiene copolymer, polyvinylidene chloride, polyvinyl chloride, polyvinylidene chloride fluoride, polyvinylidene fluoride, polyester, polyamide and acrylic resin. Especially, styrene/butadiene copolymer and polyvinylidene chloride are preferred. These polymers preferably contain a hydroxyl group, a carboxyl group, an amino group and/or a carbonyoxycarbonyl group, which can be generally introduced into the polymers by copolymerization.

The subbing layer is preferably formed of a latex of the above polymer. Especially, styrene/butadiene copolymer latex and polyvinylidene chloride latex are preferred. The styrene/butadiene copolymer latex or polyvinylidene chloride latex preferably has, as copolymerized unit, a recurring unit derived from (meth)acrylic monomer having hydroxy (e.g., hydroxyethyl acrylate), alkyl (meth)acrylate monomer (e.g., methyl acrylate, methyl methacrylate), acrylnitrile, (meth)acrylic monomer having carboxyl (e.g., acrylic acid) and polyfunctional monomer (e.g., divinylbenzene). The styrene/butadiene copolymer latex or polyvinylidene chloride latex preferably has the recurring unit in an amount of not more than 20 molar %.

The subbing layer preferably is a layer of polymer crosslinked by a crosslinking agent. The crosslinking agent also serves as an agent for improving adhesion. Examples of the crosslinking agents include aldehydes such as formaldehyde, glyoxal and glutaraldehyde; N-methylol compounds such as dimethylol urea and methyloldimethylhydantoin; dioxane derivatives such as 2,3-dihydroxydioxane; compounds capable of reacting by activation of carboxyl group of polymer such as carbenium, 2-naphthalene sulfonate, 1,1-bispyrrolydino-1-chloropyridinium and 1-morphorinocarbonyl-3-(sulfonatoaminomethyl); activated vinyl compounds such as 1,3,5-triacryloyl-hexahydro-s-triazine, bis(vinylsulfone) methane and N,N'-methylenebis-[β-(vinylsulfonyl) propionamide]; triazine derivatives such as 2,4-dichloro-6-dihydroxy-s-triazine; compounds having an epoxy group such as bisphenol A-type epoxy resin, versatic acid glycidyl ester and phenylglicidyl ether; isooxazoles; melamine resin; isocyanate compounds and dialdehyde starch. The crosslinking agent can be employed singly or in combination. Preferred are triazine derivatives.

The crosslinking agent is preferably employed in an amount of 0.1 to 20 weight % based on a weight of polymer, especially an amount of 0.5 to 15 weight %.

The polymer mainly constituting the subbing layer may be employed singly or in combination. A coating liquid for forming the subbing layer can contain various surfactants for improving coating property (e.g., surface quality of coated layer), in addition to the crosslinking agent.

The subbing layer can be, for example, formed by coating a coating liquid comprising the polymer (latex) and the crosslinking agent, and the surfactant if desired, on the support, and drying under heating. The coating procedure can be dibe by any conventional means such as an air doctor coater, a blade coater, a rod coater, a knife coater, a squeeze coater, a reverse roll coater, and a wire bar coater. The drying procedure is generally conducted under the conditions of a temperature of 50 to 180° C. for 1 to 20 minutes, preferably the conditions of a temperature of 90 to 150° C. for 2 to 15 minutes. For drying, a hot-air oven is preferably employed. A thickness of the subbing layer generally is in the range of 0.05 to 10 μm, and preferably in the range of 0.1 to 5 μm.

The surface of the support, on which the subbing layer or the transparent colorant-receptive layer is provided, may be beforehand subjected to a corona discharge treatment, a flame treatment and an ultraviolet-light irradiation treatment in order to improve adhesion between the support and the subbing layer or transparent colorant-receptive layer.

On the support or the subbing layer, the transparent colorant-receptive layer is provided. The transparent colorant-receptive layer can be, for example, formed by coating a coating liquid obtained by dispersing crosslinked polymer particles having a mean particle diameter of not more than 200 nm in a water-soluble resin solution, on the support or the subbing layer, and drying the coated layer.

Examples of the water-soluble resins include resins having a hydroxyl group as a hydrophilic constituent unit such as polyvinyl alcohol (PVA), ethylene-modified polyvinyl alcohol, cellulose resins (e.g., methyl cellulose (MC), ethyl cellulose (EC), hydroxyethyl cellulose (HEC), carboxymethyl cellulose (CMC)), chitins and starch; resins having an ether linkage such as polyethylene oxide (PEO), polypropylene oxide (PPO), polyethylene glycol (PEG) and polyvinyl ether (PVE); and resins having an amide group or amide linkage such as polyacrylamide (PAAM), polyvinyl pyrrolidone (PVP) and a copolymer of vinylpyrrolidone and a monomer copolymerizable with the vinylpyrrolidone. Also employable are resins having a carboxyl group as dissociation group such as polyacrylic acid salts, maleic acid resins, alginic acid salts and gelatins; resins having sulfone group, such as polystyrenesulfonic acid salts; and resins having an amino group, imino group, tertiary amine or quaternary ammonium salt such as polyallylamine (PAA), polyethyleneimine (PEI), epoxidized polyamide (EPAm) and polyvinyl pyridine and gelatins.

Preferred are polyvinyl alcohol, polyvinyl pyrrolidone and a copolymer of vinylpyrrolidone and a monomer (other monomer) copolymerizable with the vinylpyrrolidone. Examples of the monomers copolymerizable with the vinylpyrrolidone include vinyl acetate, styrene, various acrylic monomers such as alkyl (meth)acrylates (e.g., methyl methacrylate), maleic anhydride, vinyl chloride and ethylene. Preferred is vinyl acetate. The ratio of vinylpyrrolidone and other monomer preferably is 99/1 to 50/50 by mole.

Further, the combination of polyvinyl alcohol and polyvinyl pyrrolidone or the copolymer is preferred because an amount of unfixed ink on the resultant colorant receptive layer is greatly reduced and bronze luster (bronzing) is scarcely produced on an image formed on the colorant receptive layer. The ratio of polyvinyl alcohol and polyvinyl pyrrolidone or the copolymer is preferably in the range of 90/10 to 10/90 by weight.

The water-soluble resin constituting the transparent colorant-receptive layer is preferably cured by a crosslinking agent, in order to improve water resistance of the transparent colorant-receptive layer. The transparent colorant-receptive layer is preferably formed by adding the crosslinking agent to a liquid obtained by dispersing the crosslinked polymer particles in a water-soluble resin to prepare a coating liquid, coating the coating liquid on the support or the subbing layer, and drying the coated layer under heating to cure (cross-link).

Examples of the crosslinking agents include aldehydes such as formaldehyde, glyoxal and glutaraldehyde; N-methylol compounds such as dimethylol urea and methyloldimethylhydantoin; dioxane derivatives such as 2,3-dihydroxydioxane; compounds capable of reacting by activation of carboxyl group of polymer such as carbenium, 2-naphthalene sulfonate, 1,1-bispyrrolydino-1-chloropyridinium and 1-morphorinocarbonyl-3-(sulfonatoaminomethyl); activated vinyl compounds such as 1,3,5-triacryloyl-hexahydro-s-triazine, bis(vinylsulfone) methane and N,N'-methylenebis-[β-(vinylsulfonyl) propionamide]; triazine derivatives such as 2,4-dichloro-6-dihydroxy-s-triazine; compounds having an epoxy group such as bisphenol A-type epoxy resin, versatic acid glycidil ester and phenylglicidyl ether; isooxazoles; melamine resin; isocyanate compounds and dialdehyde starch. The crosslinking agent can be singly employed or in combination. Preferred are aldehydes such as glutaraldehyde and melamine resin which have high reactivity, from the viewpoint of productivity.

The crosslinking agent is preferably employed in an amount of 0.1 to 20 weight % based on a weight of water-soluble resin, especially an amount of 0.5 to 15 weight %.

The transparent colorant-receptive layer contains crosslinked polymer particles having a mean particle diameter of not more than 200 nm. The crosslinked polymer particles preferably are anionic or cationic polymer particles. The crosslinked polymer particles can be generally prepared by emulsion polymerization of at least one monomer selected from the group consisting of alkyl acrylates, alkyl methacrylates, styrene and styrene derivatives together with an emulsifier having at least one (preferably two or more) carbon-carbon double bond in its molecule. As crosslinked polymer particles, a micro-gel described in Japanese Patent Provisional Publication No. 5(1993)-254251 is preferably employed.

Examples of alkyl acrylates and alkyl methacrylates include alkyl (meth)acrylates wherein alkyl has 1 to 18 carbon atom such as methyl (meth)acrylate, ethyl (meth) acrylate, n-propyl (meth)acrylate, iso-propyl (meth)acrylate, n-butyl (meth)acrylate, iso-butyl (meth)acrylate, 2-ethylhexyl (meth)acrylate and stearyl (meth)acrylate. Examples of styrene derivatives include α-styrene and vinyltoluene.

Other monomers copolymerizable with the above monomers can be employed in an amount of not more than 50 weight % based on the total amount of monomers. Examples of other monomers include anionic vinyl monomers such as acrylic acid, methacrylic acid, maleic anhydride, styrenesulfonic acid and 2-acrylamide-2-methylpropanesulfonic acid; cationic vinyl monomers such as dimethylaminoethyl (meth)acrylate, diethylaminoethyl (meth)acrylate and vinyl monomers having quaternary ammonium salt; and nonionic vinyl monomers such as 2-hydoxyethyl (meth)acrylate, 2-hydoxypropyl (meth)acrylate and (meth) acryloyloxyphosphate.

In addition to the above monomers, monomers capable of cross-linking (i.e., monomers having two or more vinyl groups (functional groups)) can be employed in an amount of not more than 5 weight % based on the total amount of monomers. Examples of monomers capable of cross-linking include bifunctional monomers such as ethylene glycol di(meth)acrylate, triethylene glycol di(meth)acrylate, hexamethylenebis(meth)acrylamide and divinylbenzene; trifunctional monomers such as 1,3,5-triacryloylhexahydro-s-triazine and triallylisocyanurate; and tetrafunctional monomers such as tetramethylolmethane tetraacrylate and N,N, N',N'-tetraallyl-1,4-diaminobutane. In the case that the emulsifier having only one carbon-carbon double bond is employed, the above monomers capable of cross-linking should be employed.

The emulsifier employed for forming the crosslinked polymer particles has at least one (preferably two or more) carbon-carbon double bond. Examples of the carbon-carbon double bonds include an allyl group, a 1-propenyl group, a 2-methyl-1-propenyl group, a vinyl group, an isopropenyl group, and a (meth)acryloyl group. Preferred is a (meth) acryloyl group.

The emulsifier has both a hydrophobic group and a cationic or anionic group showing emulsification action. The cationic group is capable of giving a good property keeping ink on the transparent colorant-receptive layer, and therefore improves water resistance of the colorant-receptive layer. The emulsifier, hence, preferably has a cationic group. Examples of cationic or anionic groups include —COOH, —COOM, —$OSO_3M$, —$N(R^1)(R^2)(R^3)$, —OH, —$PO(OM)_2$, $(—O)_3P$, $(—O)_2P(OH)$—, —$OP(OH)_2$—, —$OPO(OM)_2$, —$(—O)_2PO(OM)$, $(—O)_3PO$ and —(OR)—; in which M represents Na or K, each of $R^1$, $R^2$ and $R^3$ represents independently hydrogen, alkyl, aralkyl or hydroxyalkyl, and R represents ethylene or propylene. Preferred is —$N(R^1)(R^2)(R^3)$ in which each of $R^1$, $R^2$ and $R^3$ represents independently hydrogen, alkyl or hydroxyalkyl, provided that at least one of $R^1$, $R^2$ and $R^3$ represents alkyl or hydroxyalkyl.

The emulsifier has both functions of emulsifying and polymerizing (cross-linking). Therefore, the cationic or anionic groups are generally present on the surfaces of the crosslinked polymer particles although the groups may be present inside of the particles.

Examples of the emulsifiers include salt of sulfosuccinic acid ester of polyoxyethylene alkyl ether having two or more carbon-carbon double bonds in its molecule, salt of sulfuric acid ester of polyoxyethylene alkyl ether having two or more carbon-carbon double bonds in its molecule, salt of sulfosuccinic acid of polyoxyethylene alkylphenyl ether having two or more carbon-carbon double bonds in its molecule, salt of sulfuric acid ester of polyoxyethylene alkylphenyl ether having two or more carbon-carbon double bonds in its molecule, acid (meth)acrylate phosphate, phosphoric acid oligoester (meth)acrylate or its alkali salt, and oligoester poly(meth)acrylate of polyalkylene glycol having a hydrophilic alkylene oxide group. The examples are, for example, commercially available as KAYAMER PM-2 (manufactured by Nippon Kayaku Co., Ltd.), and New Frontier A-292E and N-250Z (manufactured by Dai-ichi Kogyo Seiyaku Co., Ltd.).

In the case the emulsifier having two or more carboncarbon double bond in its molecule is employed, an emulsifier having one carbon-carbon double bond in its molecule can be employed in an amount of not more than 60 weight % based on the total amount of emulsifier. An ordinary anionic, cationic or nonionic emulsifier may be employed together with the emulsifier having at least one carbon-carbon double bond.

The emulsifier having at least one carbon-carbon double bond is generally employed in an amount of 1 to 20 weight % based on the total amount of monomers, and preferably in an amount of 3 to 10 weight %.

The crosslinked polymer particles contained in the transparent colorant respective layer can be obtained by polymerizing the above-mentioned materials (monomers and emulsifiers) according to the known emulsion polymerization method.

For instance, the crosslinked polymer particles can be prepared by the steps of: placing the emulsifier and water in a vessel, adding the monomer to the aqueous solution to emulsify the monomer, further adding a polymerization initiator to the emulsion, and heating the emulsion with stirring to polymerize the monomer and emulsifier. The monomer may be dropwise added in a lump, or potionwise. The concentration of the materials (monomer, emulsifier, initiator) in the reaction mixture is generally adjusted to give the resultant emulsion having a solid content of 20 to 50 weight % (preferably 30 to 45 weight %). In the reaction, pH is generally controlled in the range of 3 to 9, and temperature is generally controlled in the range of 40 to 90° C., preferably 50 to 80° C., although the temperature is not restricted so long as the initiator is activated. The reaction is generally performed for 30 minutes to 2 hours.

Examples of the polymerization initiators include water-soluble radical polymerization initiators such as peroxodisulfates (e.g., potassium peroxodisulfate and ammonium peroxodisulfate), hydrogen peroxide, and water-soluble azo initiators; and redox polymerization initiators such as combinations of the above peroxodisulfates and reducing agents (e.g., sodium hydrogensufite, sodium thiosulfate). Preferred are redox polymerization initiators. The polymerization initiator is generally employed in an amount of 0.05 to 5 weight % based on the total amount of monomer, preferably 0.1 to 3 weight %.

To prepare a crosslinked polymer particles having extremely fine size and high transmittance, the polymerization is preferably performed in the presence of a transition metal ion as polymerization accelerator.

The crosslinked polymer particles obtained in the above manner have an emulsifier on surface thereof, and an anionic or cationic group (hydrophilic group) of the emulsifier is fixed on the surface of the particles by bonding to the surface. Therefore, an aqueous ink for ink-jet recording (i.e., ink-jet printer) can easily adsorb on the surface of crosslinked polymer particles, because the anionic or cationic group of emulsifier greatly effects its adsorptive function. However, a part of the anionic or cationic group may be present inside of the polymer particles depending upon the kind or amount of emulsifier or the polymerization method.

The resultant reaction liquid containing the crosslinked polymer particles obtained in the above manner generally has a solid content of 20 to 50 weight % (preferably to 45 weight %), and a means particle size is. not more than 200 nm, preferably in the range of 1 to 100 nm. Further, the reaction liquid (dispersion) containing the crosslinked polymer particles of a solid content of 40 weight % generally has a viscosity of 100 to 500 cps.

The ratio of the crosslinked polymer particles and the water-soluble resin generally is in the range of 1:1 to 1:10 (polymer particles:resin) by weight, preferably in the range of 1:1 to 1:5.

The transparent colorant-receptive layer can further contain a matting agent (lubricant) to reduce friction properties on the surface of the recording sheet (i.e., improvement of running property and blocking property), in addition to the crosslinked polymer particles and the water-soluble resin. Examples of the matting agents include inorganic particles such as silica, colloidal silica, calcium silicate, zeolite, kaolinite, halosite, white mica, talc, calcium carbonate, calcium sulfate and boehmite; and organic polymer particles such as polymethyl methacrylate particles, polystyrene particles and polyethylene particles. Preferred are silica, colloidal silica, and polymethyl methacrylate particles. The matting agent is preferably contained in the transparent colorant-receptive layer in an amount of 0.01 to 5 weight %.

Each of the crosslinked polymer particles and the water-soluble resin, both of which are major components of the colorant-receptive layer, may be used singly or in combination of plural kinds. Though the transparent colorant-receptive layer are mainly composed of the crosslinked polymer particles and the water-soluble resin, the layer may contain, other than those materials, various kinds of inorganic salts to improve dispersibility of the particles, acids or alkalis as pH adjusters. The colorant-receptive layer may further contain various surface active agents to enhance coating properties and surface smoothness. Moreover, the colorant-receptive layer may also contain mordants to fix a dye and to enhance water resistance in the ink-jet recording. The layer may further contain various kinds of antioxidants and ultraviolet light absorbers to inhibit deterioration of a colorant. Furthermore, the colorant-receptive layer may contain fluorescent brightening agents.

The transparent colorant-receptive layer can be provided on the transparent support, for example, in the manner described as follows:

An aqueous dispersion (coating liquid) containing the crosslinked polymer particles and the water-soluble resin can be coated on the support (i.e., transparent support or opaque support having high gloss) by any conventional means such as an air doctor coater, a blade coater, a rod coater, a knife coater, a squeeze coater, a reverse coater and a bar coater, and dried, to form a transparent colorant-receptive layer. The drying is generally conducted under the conditions of a temperature of 50 to 180° C. for 1 to 20 minutes, preferably the conditions of a temperature of 90 to 150° C. for 2 to 15 minutes. For drying, a hot-air dryer (oven) is preferably employed. The thickness of the transparent colorant-receptive layer generally is in the range of 1 to 50 $\mu$m, and preferably in the range of 5 to 50 $\mu$m.

After the coating procedure and the drying procedure are complete, the support having the coated layer may be passed through a roll nip under heating and applying a pressure using a super calendar, a gloss calendar, etc., whereby the resulting colorant-receptive layer can be improved in the surface smoothness, the transmission and the film strength.

The image forming method of the invention is, for example, conducted using the resultant recording sheet as follows:

An aqueous ink is imagewise jetted onto the transparent colorant-receptive layer of the above-mentioned recording sheet to form an image on the transparent colorant-receptive layer. The aqueous ink is generally jetted from a nozzle of a ink-jet printer. Employable are a black and white ink-jet printer and a color ink-jet printer. The aqueous ink is generally prepared by dissolving water-soluble dye in water, further adding binder, etc. if desired. The aqueous ink preferably contains water in an amount of not less than 50 weight %.

The transparent colorant-receptive layer of the recording sheet of the invention is a layer that the crosslinked polymer particles having a mean particle diameter of not more than 200 nm is uniformly dispersed in the water-soluble resin. It is estimated that an aqueous ink jetted from a nozzle of an ink-jet printer is absorbed in the crosslinked polymer particles and the water-soluble resin, and between the crosslinked polymer particles and the water-soluble resin. In the case that the ink is jetted onto a colorant-receptive layer composed of only water-soluble resin, after the colorant-receptive layer absorbs the ink, the layer swells by the ink to produce an large amount of unfixed ink (of the image) on the colorant receptive layer. In the transparent colorant-receptive layer of the invention, an amount of the ink that the water-soluble resin of the layer adsorbs is a little, and therefore the layer scarcely swells by the ink, whereby the layer scarcely produces unfixed ink on the colorant-receptive layer. Particularly, in the case that the crosslinked polymer particles are anionic or cationic (preferably cationic) particles, the amount of unfixed ink on the colorant receptive layer is greatly reduced because the particles have a strong affinity for the ink. Moreover, since the transparent colorant-receptive layer of the invention needs not to contain inorganic particles which are usually employed to reduce an amount of unfixed ink and therefore the transparent colorant-receptive layer shows high transmittance, the recording sheet having the layer is suitably employed for forming OHP sheet. Further, also in the case that the transparent colorant-receptive layer is provided on an opaque support having a high gloss, the resultant recording sheet shows a high gloss without lowering the gloss of the support. An image which is formed on the recording sheet by ink-jet recording also shows a high quality.

Furthermore, the crosslinked polymer particles in the transparent colorant-receptive layer has a small particle size (i.e., not more than 200 nm), and therefore a light at lower wavelength of visual rays (e.g., a light of 400 nm) is scarcely scattered on the layer, whereby the image formed on the layer shows a good transparent and has a high quality.

Particularly, in the case that polyvinyl pyrrolidone or copolymer obtained from vinyl pyrrolidone and other monomer is employed as the water-soluble, a dye in the ink hardly crystallizes on the colorant-receptive layer containing polyvinyl pyrrolidone etc. Therefore, bronze luster (bronzing) is scarcely produced on an image formed on the colorant-receptive layer even when the image formed on the colorant-receptive layer is stored for a long time period.

The recording sheet of the invention wherein the transparent colorant-receptive layer is provided on the transparent support has a transmittance of not less than 80%, preferably a transmittance of not less than 83%, and especially transmittance of not less than 85%. The transmittance of a light at wavelength of 400 nm generally is not less than 80%, preferably not less than 83%.

The recording sheet of the invention wherein the transparent colorant-receptive layer is provided on the opaque support having a high gloss also has a gloss of not less than 70% on the surface, preferably gloss of not less than 75%, and especially gloss of not less than 80%.

The present invention is further described by the following examples. In these examples, "parts" means "weight parts".

EXAMPLE 1

(1) Composition of a coating liquid for forming a colorant-receptive layer

| | |
|---|---|
| (i) Polyvinyl alcohol (10 weight % aqueous solution, trade name: PVA210, available from Kuraray Co., Ltd.) | 35 parts |
| (ii) Anionic crosslinked polymer particles (10 weight % aqueous dispersion, mean diameter: 80 nm, acrylic resin particles crosslinked by emulsifier having two carbon-carbon double bonds and phosphate group, available from Arakawa Kagaku Kogyou Co., Ltd.) | 15 parts |
| (iii) Matting agent (4 Weight % aqueous dispersion of Syloid #620, available from Fuji Devison Chemical Co., Ltd.) | 1 part |
| (iv) Surfactant (10 Weight % aqueous dispersion of Megafack F-144D, available from Dainippon Ink & Chemicals Inc.) | 1 part |

The materials of the above composition were mixed to prepare a coating liquid for forming a colorant-receptive layer.

(2) Coating and drying

A surface of a biaxially oriented polyethylene terephthalate film having a thickness of 100 $\mu$m was subjected to a corona discharge treatment. The coating liquid obtained above was coated on the treated surface of the film with a bar coater, and dried at 120° C. for 10 minutes by means of a hot-air dryer, to form a colorant-receptive layer having a dry thickness of 8 $\mu$m.

Thus, a recording sheet for ink-jet recording was obtained.

EXAMPLE 2

The procedures of Example 1 were repeated except for employing cationic crosslinked polymer particles (mean diameter: 73 nm, polystyrene particles crosslinked by emulsifier having two carbon-carbon double bonds and quaternary ammonium salt group, trade name: Mistpearl C-100, available from Arakawa Kagaku Kogyou Co., Ltd.) instead of the anionic crosslinked polymer particles, to prepare a recording sheet for ink-jet recording.

EXAMPLE 3

The procedures of Example 2 were repeated except for adding the following materials as crosslinking agent to the composition of a coating liquid for forming a colorant-receptive layer of Example 2, to prepare a recording sheet for ink-jet recording.

| Materials (crosslinking agent) | |
|---|---|
| (i) Melamine resin (10 Weight % aqueous dispersion of Sumilase #613, available from Sumitomo Chemical Co., Ltd.) | 4.5 parts |
| (ii) Amine hydrochloride (5 Weight % aqueous dispersion of ACX-P, available from Sumitomo Chemical Co., Ltd.) | 0.45 part |

COMPARISON EXAMPLE 1

The procedures of Example 1 were repeated except for employing the following composition as the composition of a coating liquid for forming a colorant-receptive layer, to prepare a recording sheet for ink-jet recording.

(1) Composition of a coating liquid for forming a colorant-receptive layer

| | |
|---|---|
| (i) Polyvinyl alcohol (10 weight % aqueous solution, trade name: PVA210, available from Kuraray Co., Ltd.) | 150 parts |
| (ii) Synthetic silica (mean diameter: 20 nm) | 80 parts |
| (iii) Fine particles of glass | 20 parts |
| (iv) Water | 310 parts |

COMPARISON EXAMPLE 2

The procedures of Example 1 were repeated except for employing the following composition as the composition of a coating liquid for forming a colorant-receptive layer, to prepare a recording sheet for ink-jet recording.

(1) Composition of a coating liquid for forming a colorant-receptive layer

| | |
|---|---|
| (i) Polyvinyl pyrrolidone (trade name: PVPK-90, available from GAF Co., Ltd.) | 4.5 parts |
| (ii) Dibenzylidene sorbitol (Gelol D) | 4.5 parts |
| (iii) Cationic poler (Acrylic resin containing quaternary ammonium salt, PQ-10, available from Souken Kagaku Co., Ltd.) | 1.0 part |
| (iv) DMF | 90.0 parts |

Evaluation on Recording Sheet

Each of the recording sheets obtained above (Examples 1–3 and Comparison Examples 1–2) was evaluated on the physical properties in the following manner.

(1) Transmittance of parallel rays

The transmittance of parallel rays (at wavelengths of 380 to 800 nm) was measured using a haze meter (HGM-2DP, produced by Suga Testing Machine Co., Ltd.).

(2) Transmittance of a light at wavelength of 400 nm

The transmittance of a light at wavelength of 400 nm was measured using a spectrophotometer (Instant multi-photometry system, MCPD-1000, produced by Otsuka Denshi Co., Ltd.).

Each of the recording sheets for ink-jet recording obtained above was evaluated on the characteristics in the following manner.

(3) An amount of unfixed ink (of ink image) on colorant-receptive layer

Solid printing with blue ink was conducted on the recording sheet using an ink-jet printer (BJC-600J, produced by Canon, Inc.), and after 10 seconds a paper sheet for copy (Paper sheet WR for electrophotography (PPC), available from Fuji Xerox Co., Ltd.) was pressed onto the recording sheet using a rubber roller (linear pressure: 0.6 kg/cm). The amount of ink transferred on the paper sheet for copy was determined by measuring the reflection density of the transferred ink image portion by a reflection densitometer (X-rite, available from X-rite Incorporated). The higher the reflection density is, the more the amount of unfixed ink is.

(4) Bleeding of ink under high humidity

Using the same printer as described above (3), solid printing with red, yellow, blue and black inks was conducted on the recording sheet. The printed sheet was allowed to stand in an atmosphere of 28° C. and 85% RH for three days. The ink bleeding at boundaries of the printed solid portions of those inks was observed, and the bleeding was evaluated based on the following classification.

AA: No bleeding of ink was observed.

BB: A little bleeding of ink was observed.

CC: An amount of bleeding of ink was observed.

The results of the above evaluation are set forth in Table 1.

TABLE 1

| | Transmittance (%) | Transmittance 400 nm (%) | Amount of Unfixed Ink | Ink Bleeding |
|---|---|---|---|---|
| Ex. 1 | 86 | 84 | 0.17 | BB |
| Ex. 2 | 87 | 85 | 0.15 | AA |
| Ex. 3 | 87 | 84 | 0.15 | AA |
| Co. Ex. 1 | 14 | — | 0.20 | CC |
| Co. Ex. 2 | 82 | — | 0.65 | AA |

EXAMPLE 4

The procedures of Example 3 were repeated except for employing the following polyethylene terephthalate film having a subbing layer as the transparent support, to prepare a recording sheet for ink-jet recording.

(1) Preparation of polyethylene terephthalate film having a subbing layer

| [Coating liquid for forming subbing layer] | |
|---|---|
| Styrene/butadiene copolymer (i) (styrene/butadiene/hydroxyethyl acrylate/divinylbenzene/acrylic acid = 63/33/3/0.5/0.5 by molar %, solid content: 43 weight %) | 192 parts |
| Styrene/butadiene copolymer (ii) (styrene/butadiene/hydroxyethyl acrylate/acrylic acid = 58/40/1/1 by molar %, solid content: 43 weight %) | 54 parts |
| Sodium salt of 2,4-dichloro-6-hydroxy-s-triazine (4 weight % aqueous solution) | 73 parts |
| Water | 681 parts |

The above materials were mixed to prepare a coating liquid for forming a subbing layer.

A surface of a biaxially oriented polyethylene terephthalate film having a thickness of 100 μm was subjected to a corona discharge treatment. The coating liquid was coated on the treated surface of the film with a bar coater (#3.2), and dried at 120° C. for 5 minutes by means of a hot-air dryer, to form a subbing layer having a dry thickness of 0.6 μm.

On the subbing layer, the coating liquid for forming a colorant-receptive layer employed in Example 3 was coated and dried in the same manner as in Example 3, to prepare a recording sheet for ink-jet recording.

EXAMPLE 5

The procedures of Example 4 were repeated except for preparing a polyethylene terephthalate film having a subbing layer in the following manner, to prepare a recording sheet for ink-jet recording.

(1) Preparation of polyethylene terephthalate film having a subbing layer

| [Coating liquid for forming subbing layer] | |
|---|---|
| Polyvinylidene chloride (vinylidene chloride/methyl methacrylate/methyl acrylate/acrylonitrile/acrylic acid = 90/4/4/1/1 by molar %, solid content: 48 weight %) | 389 parts |
| Sodium salt of 2,4-dichloro-6-hydroxy-s-triazine (4 weight % aqueous solution) | 70 parts |
| Water | 541 parts |

The above materials were mixed to prepare a coating liquid for forming a subbing layer.

A surface of a biaxially oriented polyethylene terephthalate film having a thickness of 100 μm was subjected to a corona discharge treatment. The coating liquid was coated on the treated surface of the film with a bar coater (#4.8), and dried at 120° C. for 5 minutes by means of a hot-air dryer, to form a subbing layer having a dry thickness of 1.5 μm.

EXAMPLE 6

The procedures of Example 4 were repeated except for changing Syloid #620 (matting agent) to MX-1000 (available from Souken Kagaku Co., Ltd.) and employing it in the same amount, to prepare a recording sheet for ink-jet recording.

EXAMPLE 7

The procedures of Example 4 were repeated except for employing cationic crosslinked polymer particles (mean diameter: 52 nm, polystyrene particles crosslinked by emulsifier having two carbon-carbon double bond and quaternary ammonium salt group, trade name: Mistpearl C-150, available from Arakawa Kagaku Kogyou Co., Ltd.) instead of Mistpearl C-100, to prepare a recording sheet for ink-jet recording.

EXAMPLE 8

The procedures of Example 4 were repeated except for preparing a polyethylene terephthalate film having a subbing layer in the following manner, to prepare a recording sheet for ink-jet recording.

(1) Preparation of polyethylene terephthalate film having a subbing layer

| [Coating liquid for forming subbing layer] | |
|---|---|
| Water-soluble polyester (copolymer) (WD size, available from Eastman Kodak Co.) | 90 parts |
| Melamine (Sumiteck resin M-3, available from Sumitomo Chemical Co., Ltd.) | 10 parts |

Water was added to a mixture of the above materials to prepare a 5 weight % aqueous coating solution for forming a subbing layer.

A surface of a biaxially oriented polyethylene terephthalate film having a thickness of 100 μm was subjected to a corona discharge treatment. The coating liquid was coated on the treated surface of the film with a bar coater, and dried at 120° C. for 5 minutes by means of a hot-air dryer, to form a subbing layer having a dry thickness of 1 μm.

Evaluation on Recording Sheet

Each of the recording sheets obtained above (Examples 4–8) was evaluated on the physical properties: (1) Transmittance of parallel rays and (2) Transmittance of a light at wavelength of 400 nm, which were evaluated in the same manner as in the above-mentioned methods.

Each of the recording sheets for ink-jet recording obtained above was evaluated on the following characteristics: (3) An amount of unfixed ink on colorant-receptive layer and (4) Bleeding of ink under high humidity, which were evaluated in the same manner as the above-mentioned methods, and the following (5) Adhesion.

(5) Adhesion (bonding strength between support and colorant-receptive layer)

The surface of colorant-receptive layer of the resultant recording sheet was cut in a grid pattern at right angle (width: 2 mm) to form 100 squares (one square: 2×2 mm) and subjected to a cellophane tape peel test. The adhesion was ranked in the following manner.

AA: colorant-receptive layer in 100 squares are left

BB: colorant-receptive layer 70–99 squares are left

CC: colorant-receptive layer in 30–69 squares are left

DD: colorant-receptive layer in 29 or less squares are left

The results of the above evaluation are set forth in Table 2.

TABLE 2

| | Trans-mittance (%) | Trans-mittance 400 nm (%) | Amount of Unfixed Ink | Ink Bleeding | Adhesion |
|---|---|---|---|---|---|
| Ex. 4 | 87 | 85 | 0.15 | AA | AA |
| Ex. 5 | 87 | 84 | 0.15 | AA | AA |
| Ex. 6 | 87 | 85 | 0.15 | AA | AA |
| Ex. 7 | 86 | 84 | 0.17 | AA | AA |
| Ex. 8 | 87 | 85 | 0.15 | AA | BB |

EXAMPLE 9

The procedures of Example 4 were repeated except for employing the following composition as a coating liquid for forming a colorant-receptive layer and forming the colorant-receptive layer in the following manner, to prepare a recording sheet for ink-jet recording. In more detail, on the subbing layer of the support having subbing layer of Example 4, the following coating liquid was coated and dried in the following manner, to prepare a recording sheet for ink-jet recording.

(1) Composition of a coating liquid for forming a colorant-receptive layer

| | | | |
|---|---|---|---|
| (i) | Polyvinyl alcohol (10 weight % aqueous solution; trade name: PVA210, available from Kuraray Co., Ltd.)) | 30 | parts |
| (ii) | Polyvinyl pyrrolidone (10 weight % agueous solution; trade name: PVPK-80, available from ISP Co., Ltd.)) | 5 | parts |
| (iii) | Cationic crosslinked polymer particles (10 weight % aqueous dispersion, mean diameter: 52 nm, polystyrene particles crosslinked by emulsifier having two carbon-carbon double bonds and quaternary ammonium salt group, trade name: Mistpearl C-150, available from Arakawa Kagaku Kogyou Co., Ltd.) | 15 | parts |
| (iii) | Matting agent (4 Weight % dispersion of polymethyl methacrylate, trade name: MX-1000, available from Soken Kagaku Co., Ltd.) | 0.4 | part |
| (iv) | Melamine resin (10 Weight % aqueous dispersion of Sumilase #613, available from Sumitomo Chemical Co., Ltd.) | 4.5 | parts |
| (v) | Amine hydrochloride (5 Weight % agueous dispersion of ACX-P, available from Sumitorno Chemical Co., Ltd.) | 0.45 | parts |

The materials of the above composition were mixed to prepare a coating liquid for forming a colorant-receptive layer.

The coating liquid obtained above was coated on the subbing layer of the film with a bar coater, and dried at 120° C. for 10 minutes by means of a hot-air dryer, to form a colorant-receptive layer having a dry thickness of 10 $\mu$m.

EXAMPLE 10

The procedures of Example 9 were repeated except for changing the composition of coating liquid for forming a colorant-receptive layer from 30 parts of polyvinyl alcohol aqueous solution to 20 parts and from 5 parts of polyvinyl pyrrolidone to 15 parts, to prepare a recording sheet for ink-jet recording.

EXAMPLE 11

The procedures of Example 9 were repeated except for changing the composition of coating liquid for forming a colorant-receptive layer from 30 parts of polyvinyl alcohol aqueous solution to 10 parts and from 5 parts of polyvinyl pyrrolidone to 25 parts, to prepare a recording sheet for ink-jet recording.

EXAMPLE 12

The procedures of Example 9 were repeated except for employing no polyvinyl alcohol aqueous solution in the composition of coating liquid for forming a colorant-receptive layer, and changing from 5 parts of polyvinyl pyrrolidone in the composition to 35 parts, to prepare a recording sheet for ink-jet recording.

EXAMPLE 13

The procedures of Example 12 were repeated except for employing vinyl pyrrolidone/vinyl acetate copolymer (vinyl pyrrolidone/vinyl acetate=70/30, by mole) instead of polyvinyl pyrrolidone (PVPK-80), to prepare a recording sheet for ink-jet recording.

Evaluation on Recording Sheet

Each of the recording sheets obtained above (Examples 9–13) was evaluated on the physical properties: (1) Transmittance of parallel rays and (2) Transmittance of a light at wavelength of 400 nm, which were evaluated in the same manner as the above-mentioned methods.

Each of the recording sheets for ink-jet recording was evaluated on the following characteristics: (3) An amount of unfixed ink on colorant-receptive layer and (4) Bleeding of ink under high humidity, which were evaluated in the same manner as the above-mentioned methods, and the following (6) Bronze luster.

(6) Bronze luster (bronzing)

Solid printing with magenta ink was conducted on the recording sheet using an ink-jet printer (BJC-455J, produced by Canon, Inc.), and the printed sheet was allowed to stand in an atmosphere of 23° C. and 65% RH for 24 hours. Subsequently, the printed portion of the recording sheet was observed by eye. Bronze luster was ranked as follows:

AA: No bronze like luster is observed

BB: bronze like luster is locally observed.

The results of the above evaluation are set forth in Table 3.

TABLE 3

| | Trans-mittance (%) | Trans-mittance 400 nm (%) | Amount of Unfixed Ink | Ink Bleeding | Bronze Luster |
|---|---|---|---|---|---|
| Ex. 9 | 89 | 87 | 0.18 | AA | AA |
| Ex. 10 | 88 | 86 | 0.20 | AA | AA |
| Ex. 11 | 88 | 86 | 0.23 | AA | AA |
| Ex. 12 | 89 | 87 | 0.37 | AA | AA |
| Ex. 13 | 87 | 86 | 0.33 | AA | AA |

Recording sheets having high gloss were prepared and evaluated in the following examples.

EXAMPLE 14

The procedures of Example 3 were repeated except for employing the following opaque support having high gloss instead of polyethylene terephthalate film, to prepare a recording sheet for ink-jet recording.

(1) Opaque support having high gloss

A mixed pulp of 70 parts of pulp of LBPK and 30 parts of pulp of NBSP was beated using a double disk refiner to prepare 300 ml of canadian freeness. The following materials were added to the canadian freeness, processed in a paper making machine and dried to prepare a base paper of a base weight of 180 g/m$^2$.

| [Materials] | | |
|---|---|---|
| Pulp | 100 | parts |
| Epoxidized behenic amide | 0.3 | part |
| Alkylketene dimer | 0.4 | part |
| Cationic Starch | 1.0 | part |
| Polyamide polyamine epichlorohydrine | 0.2 | part |
| Cationic polyacrylamide | 0.5 | part |

The resultant base paper was subjected to size press treatment using the following sizing agent (aqueous solution), whereby the sizing agent was impregnated into the base paper in an amount of 30 g/m$^2$.

| [Sizing agent] | | |
|---|---|---|
| Polyvinyl alcohol | 4 | parts |
| γ-aminopropyltriethoxysilane | 0.05 | part |
| Fluorescent brightening agent | 0.6 | part |
| Antifoamer | 0.005 | part |
| Water | appropriate amount | |

Subsequently, the base paper having the sizing agent was subjected to soft calendar treatment to form a paper having thickness of 200 μm, and further subjected to calendar treatment to form a paper having thickness of 175 μm. The back side (wire side) of the base paper was subjected to corona discharge treatment and a polyethylene layer of density of 0.98 g/cm$^3$ (thickness: 25 μm) was formed on the back side by coating method, whereas the right side (felt side) was subjected to corona discharge treatment and then a polyethylene layer of density of 0.94 g/cm$^3$ containing titanium dioxide in an amount of 10 weight % (thickness: 30 μm) was formed on the right side by coating method. Thus, an opaque support having high gloss was obtained.

EXAMPLE 15

The procedures of Example 3 were repeated except for employing the following opaque support having a high gloss instead of polyethylene terephthalate film, to prepare a recording sheet for ink-jet recording.

(1) Opaque support having high gloss

Polyethylene terephthalate containing calcium carbonate (mean particle size: 0.9 μm) in an amount of 15 weight % was biaxially stretched to prepare a polyethylene terephthalate film (density: 0.94 g/cm$^3$, SRa: 0.17 μm). A coating liquid of polyester resin wherein tin(II) oxide was dispersed in amount of 50 weight % in a solvent was coated on both sides of the film in a coated amount of 0.3 g/cm$^2$, dried, and further an antistatic layer (surface resistance: $5\times10^8$ to $5\times10^9$ Ω) was formed on the polyester resin layer.

Both sides (i.e., antistatic layers) of the polyester film were subjected to corona discharge treatment, and a high density polyethylene layer (density: 0.960 g/cm$^3$, MI=13 g/10 minutes) having a thickness of 30 μm was formed on the one antistatic layer by melt extrusion (this side is referred to as back side).

Subsequently, a low density polyethylene layer (density: 0.923 g/cm$^3$, MI=7 g/10 minutes, thickness: 32 μm) containing 15 weight % of anatase-type titanium dioxide and a slight amount of ultramarine was formed on another antistatic layer by melt extrusion (this side is referred to as right side). The resultant low density polyethylene layer showed high gloss.

The high density polyethylene layer (back side) was subjected to corona discharge treatment, and then a liquid of antistatic agent wherein aluminum oxide (Aluminasol-100, available from Nissan Chemical Industries, Ltd.) and silicon dioxide (Snowtex-O, available from Nissan Chemical Industries, Ltd.) were dispersed at a ratio of 2/1 by weight in water, was coated on the high density polyethylene layer of a dry coated amount of 0.2 g/m$^2$. Thus, an opaque support having high gloss was obtained.

EXAMPLE 16

The procedures of Example 3 were repeated except for employing the following opaque support having a high gloss instead of polyethylene terephthalate film, to prepare a recording sheet for ink-jet recording.

(1) Opaque support having high gloss

A polyethylene terephthalate film containing 2 weight % of silica having a mean particle size of 3 μm (thickness: 25 μm) was placed in a vacuum metallizer, and a layer of aluminum (thickness: 600 Å) was formed on the film by vapor deposition (vacuum: $10^{-4}$ Torr).

On the deposited layer, a coating liquid of the following adhesive in ethyl acetate was coated in a dry coated amount of 5 g/m$^2$, and dried for 2 minutes in an oven of 100° C. Thus, a polyethylene terephthalate film having a deposited layer was prepared.

| [Adhesive] | |
|---|---|
| Vinyl acetate/vinylidene chloride/vinyl acetate/maleic anhydride copolymer | 56 parts |
| Adduct of tolylenediisocyanate to trimethylolpropane | 37 parts |
| Epoxidized fatty acid alkyl ester (molecular weight: approx. 350) | 7 parts |

A mixed pulp of 80 parts of LBPK and 20 parts of NBSP was beated using a double disk refiner to prepare 300 ml of canadian freeness. The following materials were added to the canadian freeness, processed in a machine and dried to prepare a base paper of a base weight of 160 g/m$^2$. The density was adjusted to 1.0 g/cm$^3$ using a calendar.

| [Materials] | | |
|---|---|---|
| Pulp | 100 | parts |
| Sodium stearate | 1.0 | part |
| Anionic polyacrylamide | 0.5 | part |
| Aluminum sulfate | 1.5 | parts |
| Polyamide polyamine epichlorohydrine | 0.5 | part |
| Alkylketene dimer | 0.5 | part |

One side of the resultant base paper was subjected to corona discharge treatment, and a low density polyethylene layer (density: 0.923 g/cm$^3$, MI=7 g/10 minutes, thickness: 30 $\mu$m) was formed on the one side by melt extrusion (this side is referred to as right side).

Another side of the resultant base paper was subjected to corona discharge treatment, and a high density polyethylene layer (density: 0.950 g/cm$^3$, MI=8 g/10 minutes) having a thickness of 30 $\mu$m was formed on another side of the base paper by melt extrusion (this side is referred to as back side).

Thus, a paper base sheet having polyethylene layers on both sides was prepared.

Subsequently, on the side having no deposited layer of the polyethylene terephthalate film having a deposited layer, the following adhesive (two-pack polyurethane) was coated in a dry coated amount of 3 g/m$^2$, and dried for 2 minutes in an oven of 100° C. Thus, a polyethylene terephthalate film having a deposited layer and adhesive layer was prepared.

| [Adhesive] | |
|---|---|
| Polybond AY-651A (available from Sanyo Chemical Industries, Ltd.) | 100 parts |
| Polybond AY-651C (available from Sanyo Chemical Industries, Ltd.) | 15 parts |

Subsequently, the polyethylene terephthalate film was superposed on the base paper such that the adhesive layer was in contact with the low density polyethylene layer, and pressed under heating (pressure: 20 kg/cm).

Thus, an opaque support having a high gloss was obtained. The deposited layer side corresponds to a right side.

EXAMPLE 17

The procedures of Example 3 were repeated except for employing the porous polyethylene terephthalate film containing calcium carbonate (E-68L, available from Toray Industries, Inc.; thickness: 130 $\mu$m) instead of polyethylene terephthalate film, to prepare a recording sheet for ink-jet recording.

COMPARISON EXAMPLE 3

The procedures of Comparison Example 1 were repeated except for employing the opaque support used in Example 16 instead of polyethylene terephthalate film, to prepare a recording sheet for ink-jet recording.

COMPARISON EXAMPLE 4

The procedures of Comparison Example 2 were repeated except for employing the opaque support used in Example 16 instead of polyethylene terephthalate film, to prepare a recording sheet for ink-jet recording.

Evaluation on Recording Sheet

Each of the recording sheets obtained above was evaluated on the physical property in the following manner.

(7) Gloss

As to the recording sheets and supports, 75 degree specular gloss was measured according JIS P-8142 (Testing method for 75° specular gloss of paper and paperboard). In more detail, six test pieces were prepared from each of the recording sheets and supports, and glosses of the test pieces were measured using a gloss meter (Digital variable angle gloss meter, available from Suga Shikenki Co., Ltd.). An average of the obtained six values was calculated to give the gloss of each recording sheet or support.

Each of the recording sheets for ink-jet recording obtained above was evaluated on the following characteristics: (3) An amount of unfixed ink on colorant-receptive layer and (4) Bleeding of ink under high humidity, which were evaluated in the same manner as the above-mentioned methods.

The results of the above evaluation are set forth in Table 4.

TABLE 4

| | Gloss (%) | | Amount of | |
|---|---|---|---|---|
| | Support | Recording Sheet | Unfixed Ink | Ink Bleeding |
| Ex. 14 | 87 | 85 | 0.15 | AA |
| Ex. 15 | 95 | 93 | 0.14 | AA |
| Ex. 16 | 99 | 95 | 0.16 | AA |
| Ex. 17 | 49 | 92 | 0.14 | AA |
| Co. Ex. 3 | 99 | 21 | 0.21 | CC |
| Co. Ex. 4 | 99 | 92 | 0.67 | AA |

EXAMPLE 18

The procedures of Example 4 were repeated except for employing the opaque support having a high gloss which was employed in Example 14 instead of the polyethylene terephthalate film, to prepare a recording sheet for ink-jet recording.

EXAMPLE 19

The procedures of Example 8 were repeated except for employing the opaque support having a high gloss which was employed in Example 15 instead of the polyethylene terephthalate film, to prepare a recording sheet for ink-jet recording.

EXAMPLE 20

The procedures of Example 8 were repeated except for employing the opaque support having high gloss which was employed in Example 17 instead of the polyethylene terephthalate film, to prepare a recording sheet for ink-jet recording.

EXAMPLE 21

The procedures of Example 4 were repeated except for employing the opaque support having high gloss which was employed in Example 17 instead of the polyethylene terephthalate film, to prepare a recording sheet for ink-jet recording.

Evaluation on Recording Sheet

Each of the recording sheets obtained above (Examples 18–21) was evaluated on the physical property: (7) Gloss, which was evaluated in the same manner as the above-mentioned method.

Each of the recording sheets for ink-jet recording obtained above was evaluated on the characteristics: (3). An amount of unfixed ink on colorant-receptive layer, (4) Bleeding of ink under high humidity, and (5) Adhesion, which were evaluated in the same manner as the above-mentioned methods.

The results of the above evaluation are set forth in Table 5.

TABLE 5

| | Gloss (%) | | Amount of | | |
|---|---|---|---|---|---|
| | Support | Recording Sheet | Unfixed Ink | Ink Bleeding | Adhesion |
| Ex. 18 | 88 | 84 | 0.13 | AA | AA |
| Ex. 19 | 93 | 90 | 0.14 | AA | AA |
| Ex. 20 | 49 | 92 | 0.14 | AA | AA |
| Ex. 21 | 49 | 92 | 0.14 | AA | AA |

EXAMPLE 22

The procedures of Example 9 were repeated except for employing the opaque support having high gloss which was employed in Example 17 instead of the polyethylene terephthalate film, to prepare a recording sheet for ink-jet recording.

Evaluation on Recording Sheet

The recording sheet obtained above (Example 22) was evaluated on the physical property: (7) Gloss, which was evaluated in the same manner as the above-mentioned method.

The recording sheet for ink-jet recording obtained above was evaluated on the following characteristics: (3) An amount of unfixed ink on colorant-receptive layer, (4) Bleeding of ink under high humidity, and (6) Bronze luster, which were evaluated in the same manner as the above-mentioned methods.

The results of the above evaluation are set forth in Table 6.

TABLE 6

| | Gloss (%) | | Amount of | | |
|---|---|---|---|---|---|
| | Support | Recording Sheet | Unfixed Ink | Ink Bleeding | Bronze Luster |
| Ex. 22 | 49 | 92 | 0.17 | AA | AA |

What is claimed is:

1. A recording sheet comprising a transparent support and a transparent colorant-receptive layer provided thereon, in which the colorant-receptive layer comprises crosslinked cationic polymer particles having a mean particle diameter of not more than 200 nm and a water-soluble resin, the recording sheet having a transmittance of not lower than 80%.

2. The recording sheet as defined in claim 1, wherein the water-soluble resin is a crosslinked resin.

3. The recording sheet as defined in claim 1, wherein the mean particle diameter of the crosslinked polymer particles is in the range of 1 to 100 nm.

4. The recording sheet as defined in claim 1, wherein the transparent support has a subbing layer thereon.

5. The recording sheet as defined in claim 1, wherein the water-soluble resin comprises at least one polymer selected from the group consisting of polyvinylpyrrolidone and a copolymer of vinylpyrrolidone and a monomer copolymerizable with the vinylpyrrolidone.

6. An image forming method comprising imagewise jetting an aqueous ink onto the transparent colorant-receptive layer of a recording sheet to form an image of aqueous ink on the transparent colorant-receptive layer, said recording sheet comprising a transparent support and a transparent colorant-receptive layer provided thereon, in which the colorant-receptive layer comprises crosslinked cationic polymer particles having a mean particle diameter of not more than 200 nm and a water-soluble resin, the recording sheet having a transmittance of not lower than 80%.

7. A recording sheet comprising an opaque support and a transparent colorant-receptive layer provided thereon, in which the colorant-receptive layer comprises crosslinked cationic polymer particles having a mean particle diameter of not more than 200 nm and a water-soluble resin, the recording sheet having a glass of not lower than 70%.

8. The recording sheet as defined in claim 7, wherein the water-soluble resin is a crosslinked resin.

9. The recording sheet as defined in claim 7, wherein the mean particle diameter of the crosslinked polymer particles is in the range of 1 to 100 nm.

10. The recording sheet as defined in claim 7, wherein the opaque support has a subbing layer thereon.

11. The recording sheet as defined in claim 7, wherein the water-soluble resin comprises at least one polymer selected from the group consisting of polyvinylpyrrolidone and a copolymer of vinylpyrrolidone and a monomer copolymerizable with the vinylpyrrolidone.

12. An image forming method comprising imagewise jetting an aqueous ink onto the transparent colorant-receptive layer of a recording sheet to form an image of aqueous ink on the transparent colorant-receptive layer, said recording sheet comprising an opaque support and a transparent colorant-receptive layer provided thereon, in which the colorant-receptive layer comprises crosslinked polymer particles having a mean particle diameter of not more than 200 nm and a water-soluble resin, the recording sheet having a glass of not lower than 70%.

* * * * *